US008590162B2

(12) United States Patent
Park et al.

(10) Patent No.: US 8,590,162 B2
(45) Date of Patent: Nov. 26, 2013

(54) SHAVER

(75) Inventors: Young Ho Park, Gunpo-si (KR); Byung Sun An, Ansan-si (KR)

(73) Assignee: Dorco Co., Ltd., Seoul (KR)

( * ) Notice: Subject to any disclaimer, the term of this patent is extended or adjusted under 35 U.S.C. 154(b) by 320 days.

(21) Appl. No.: 12/600,253

(22) PCT Filed: May 30, 2008

(86) PCT No.: PCT/KR2008/003039

§ 371 (c)(1),
(2), (4) Date: Nov. 13, 2009

(87) PCT Pub. No.: WO2008/147133

PCT Pub. Date: Dec. 4, 2008

(65) Prior Publication Data

US 2010/0251555 A1 Oct. 7, 2010

(30) Foreign Application Priority Data

May 31, 2007 (KR) ..... 10-2007-0053545

(51) Int. Cl.
*B26B 21/00* (2006.01)
*B26B 21/52* (2006.01)

(52) U.S. Cl.
USPC ..... 30/50; 30/526; 30/527

(58) Field of Classification Search
USPC ..... 30/50, 526–534
See application file for complete search history.

(56) References Cited

U.S. PATENT DOCUMENTS 4,266,340 A * 5/1981 Bowman ..... 30/532
4,502,216 A * 3/1985 Furnari ..... 30/50
4,514,904 A * 5/1985 Bond ..... 30/530
4,797,998 A * 1/1989 Motta ..... 30/530
4,879,811 A * 11/1989 Cooney ..... 30/527
5,157,834 A * 10/1992 Chen et al. ..... 30/532
5,347,717 A * 9/1994 Ts'ai ..... 30/532
5,787,593 A * 8/1998 Althaus ..... 30/527
5,794,354 A 8/1998 Gilder (Continued)

FOREIGN PATENT DOCUMENTS

CN 1072628 6/1993
CN 101795832 B * 7/2012

(Continued)

OTHER PUBLICATIONS

International Search Report for PCT/KR2008/003039 mailed Sep. 26, 2008.

*Primary Examiner* — Jason Daniel Prone
(74) *Attorney, Agent, or Firm* — Christopher Paul Mitchell

(57) ABSTRACT

Disclosed herein is a shaver. The shaver includes a removable cartridge and a handle assembly. The removable cartridge includes a cartridge body, at least one blade mounted to the lower surface of the cartridge body, a connector mounting part provided on the upper surface of the cartridge body, and a connector mounted to the connector mounting part and having a holder mounting part. The handle assembly includes a handle body, a housing provided on a front end of the handle body, a holder mounted to a front end of the housing in such a way as to rotate around a pivot shaft, a removing means functioning to removably couple the holder to the holder mounting part, a manipulating means installed in the housing to be operated in conjunction with the removing means, and a support means elastically supporting rotating motion of the holder using elastic force.

3 Claims, 12 Drawing Sheets

(56) References Cited

U.S. PATENT DOCUMENTS

| | | | | |
|---|---|---|---|---|
| 6,115,924 | A * | 9/2000 | Oldroyd | 30/527 |
| 6,381,857 | B1 * | 5/2002 | Oldroyd | 30/527 |
| 6,557,265 | B2 * | 5/2003 | Coffin | 30/532 |
| 6,560,881 | B2 * | 5/2003 | Coffin | 30/531 |
| 6,990,740 | B2 * | 1/2006 | Follo et al. | 30/532 |
| 7,574,809 | B2 * | 8/2009 | Follo et al. | 30/527 |
| 7,676,929 | B2 * | 3/2010 | Lembke et al. | 30/50 |
| 7,721,451 | B2 * | 5/2010 | Psimadas et al. | 30/527 |
| 7,992,304 | B2 * | 8/2011 | Nakasuka | 30/50 |
| 2002/0026721 | A1 | 3/2002 | Lee et al. | |
| 2003/0061718 | A1 * | 4/2003 | Dansreau | 30/532 |
| 2003/0079348 | A1 * | 5/2003 | Follo | 30/50 |
| 2003/0217472 | A1 * | 11/2003 | Follo | 30/527 |
| 2005/0000100 | A1 * | 1/2005 | Coffin | 30/531 |
| 2006/0260142 | A1 * | 11/2006 | Dombrowski et al. | 30/526 |
| 2009/0193659 | A1 * | 8/2009 | Park et al. | 30/50 |
| 2010/0132204 | A1 * | 6/2010 | Brown | 30/527 |
| 2011/0232100 | A1 * | 9/2011 | Park et al. | 30/50 |
| 2011/0232101 | A1 * | 9/2011 | Park et al. | 30/50 |
| 2011/0252646 | A1 * | 10/2011 | Gordon et al. | 30/527 |

FOREIGN PATENT DOCUMENTS

| | | | |
|---|---|---|---|
| JP | 2010527736 | A * | 8/2010 |
| KR | 10-2007-0015146 | | 2/2007 |
| KR | 20080105676 | A * | 12/2008 |
| KR | 100903191 | B1 * | 6/2009 |
| MX | 2009012576 | A * | 12/2009 |
| WO | 02/00401 | | 1/2002 |
| WO | WO 2007094337 | A1 * | 8/2007 |
| WO | WO 2008147133 | A1 * | 12/2008 |

* cited by examiner

--Prior Art--

Fig. 2
--Prior Art--
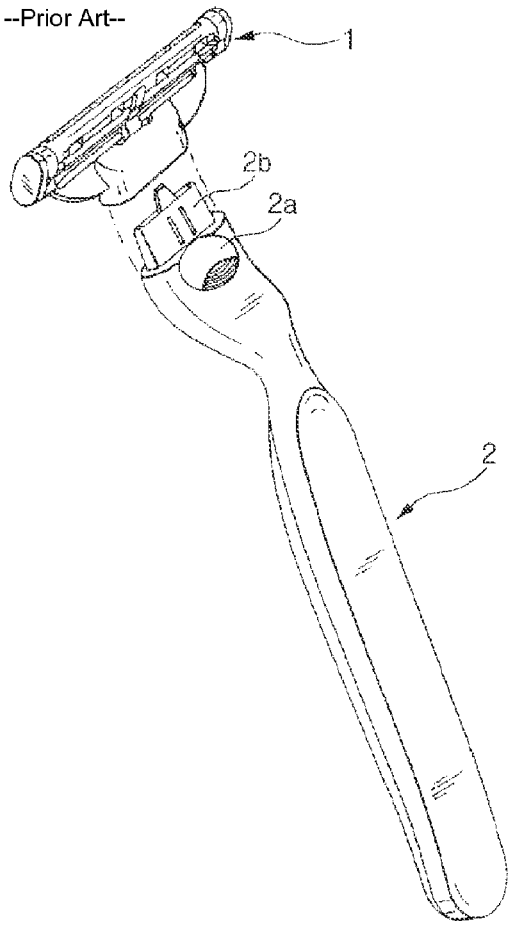
Fig. 3 --Prior Art--
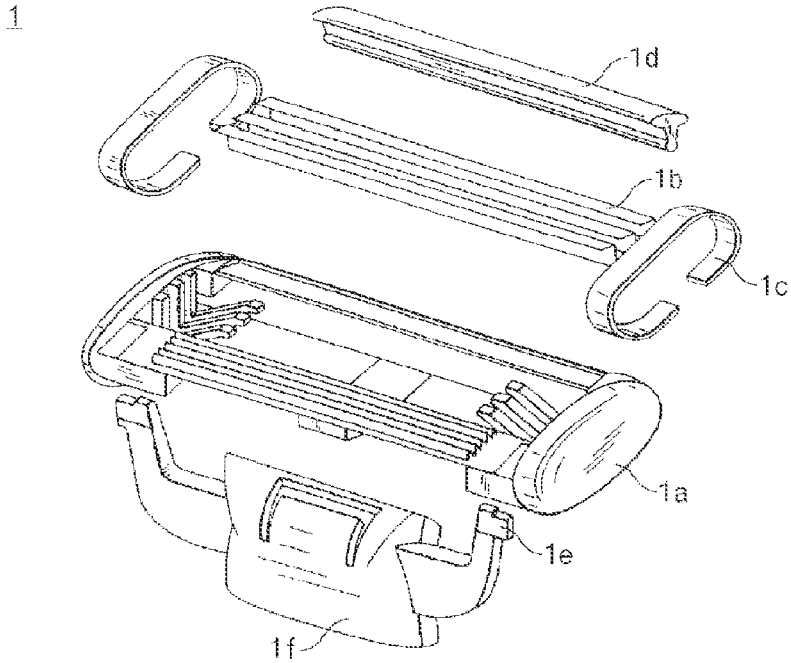

Fig. 4 --Prior Art--
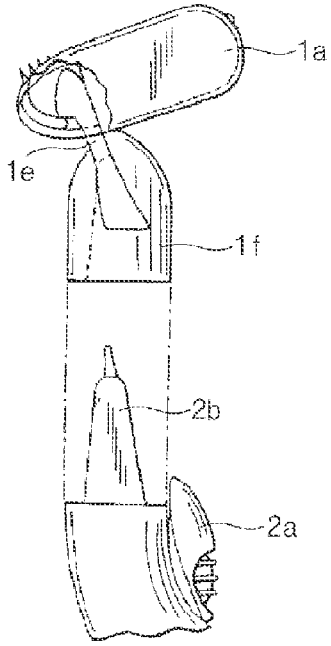
Fig. 5
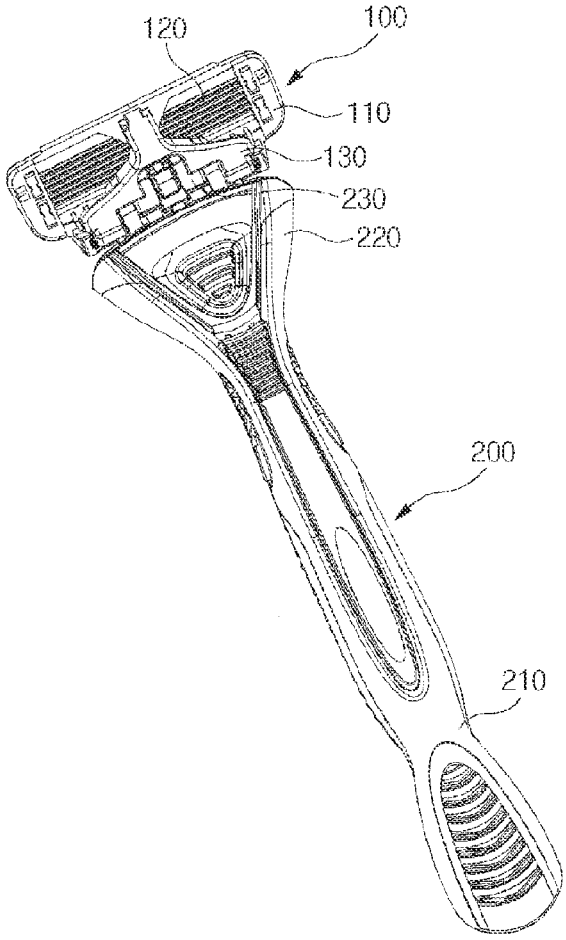

Fig. 18
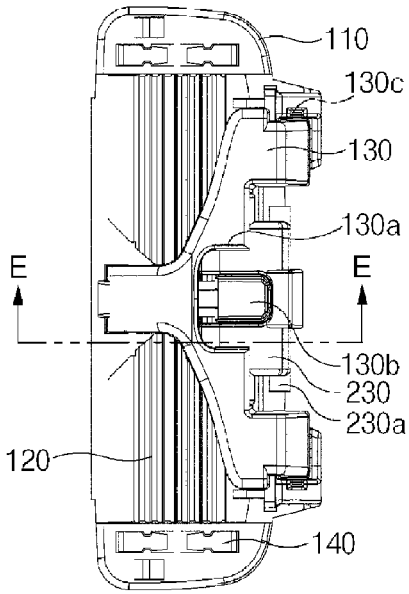
Fig. 19
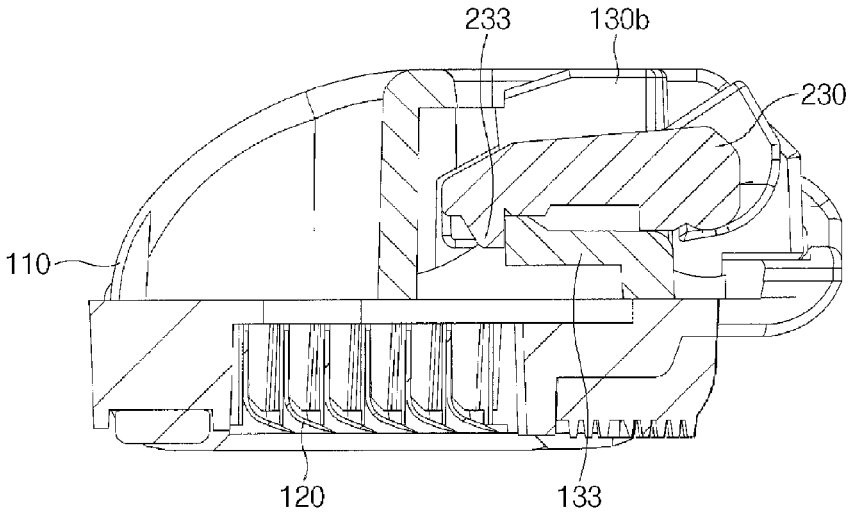
[Fig. 20]
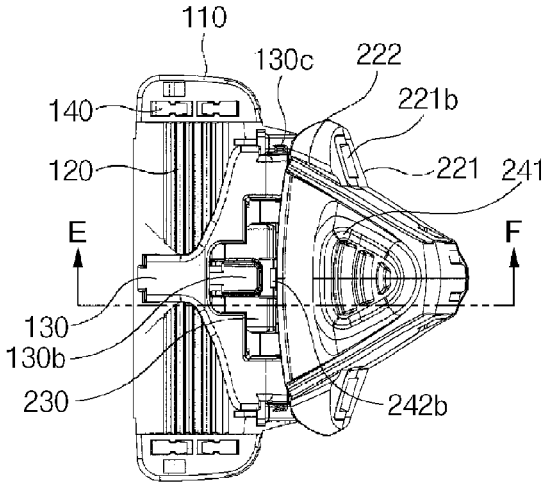

SHAVER

RELATED APPLICATIONS

This application is a 371 application of International Application No. PCT/KR2008/003039, filed May 30, 2008, which in turn claims priority from Korean Patent Application No. 10-2007-0053545, filed May 31, 2007, both of which are incorporated herein by reference in their entirety.

TECHNICAL FIELD

The present invention relates, in general, to shavers and, more particularly, to a shaver, which improves the structure of a cartridge and a handle assembly, thus simplifying the structure by which the cartridge is removably coupled to the handle assembly, and which allows the cartridge to smoothly rotate during shaving, thus increasing shaving efficiency, and which is constructed so that the cartridge is not easily separated from the handle assembly even if external force is applied to the cartridge, thus increasing the reliability of a product.

BACKGROUND ART

Hereinafter, a conventional shaver will be described in detail with reference to the accompanying drawings.

FIG. 1 is a perspective view showing a conventional shaver, FIG. 2 is a perspective view showing the state in which a cartridge and a handle included in the shaver of FIG. 1 are separated from each other, FIG. 3 is an exploded perspective view showing the cartridge of FIG. 1, and FIG. 4 is a view showing the pivot structure of the cartridge of FIG. 1.

As shown in FIG. 1, the conventional shaver includes a cartridge 1 and a handle 2.

Here, as shown in FIG. 2, the shaver is constructed so that, when a button 2*a* provided on the handle 2 is pushed towards the cartridge 1, the cartridge 1 is separated from the handle 2.

Further, as shown in FIG. 3, the cartridge 1 includes a cartridge body 1*a*, a blade 1*b*, which is fastened to the cartridge body 1*a*, clips 1*c*, which hold the opposite ends of the blade 1*b*, a lubricating band 1*d*, which is provided on the upper portion of the blade 1*b*, and a housing 1*f*, which serves to couple the cartridge body 1*a* to the handle 2.

Pivot support shafts 1*e* extend from the opposite ends of the housing 1*f* to allow the cartridge body 1*a* to rotate around the pivot support shafts 1*e*.

As shown in FIGS. 2 and 4, a coupling part 2*b* is provided on the front end of the handle 2, and is coupled to the housing 1*f* so that the cartridge 1 is removably coupled to the handle 2.

In the state where the coupling part 2*b* is coupled to the housing 1*f*, as the button 2*a* is manipulated, the coupling part 2*b* is separated from the housing 1*f*.

However, the conventional shaver constructed as described above has the following problems.

The shaver is problematic in that the pivot support structure for rotating the cartridge body 1*a* is weak, so that the cartridge 1 may be undesirably separated from the handle 2 or may break when external force is applied to the cartridge 1 during the operation of coupling or removing the cartridge 1 to or from the handle 2 or during shaving.

In a detailed description, the shaver is constructed so that the pivot support shafts 1*e* for rotating the cartridge body 1*a* are directly coupled to the cartridge 1 via the housing 1*f*, so that all external force acting on the cartridge 1 is transmitted to the pivot support shafts 1*e*. Thus, when external force is applied to the cartridge 1 during the operation of coupling or removing the cartridge 1 to or from the handle 2 or during shaving, the pivot support shafts 1*e* may be undesirably removed from the cartridge body 1*a*, or may break.

Further, the shaver is problematic in that ends of the pivot support shafts 1*e* which are to be coupled to the cartridge body 1*a* are inserted into holes formed in the cartridge body 1*a* to support the cartridge body 1*a*, so that the force supporting the cartridge body 1*a* is weak. A plurality of faces, provided on the end of each pivot support shaft 1*e*, is cam-operated to rotate the cartridge body 1*a*, so that the cartridge body 1*a* cannot smoothly rotate.

Further, the shaver is problematic in that the coupling part 2*b* of the handle 2 is removably coupled to the housing 1*f* of the cartridge 1 using the elastic force of a spring, so that the removable structure is complex, and undesirable removal may occur when external force is applied.

DISCLOSURE OF INVENTION

Technical Problem

Accordingly, the present invention has been made keeping in mind the above problems occurring in the prior art, and an object of the present invention is to provide a shaver, which simplifies the structure by which a cartridge is removably coupled to a handle assembly.

Another object of the present invention is to provide a shaver, which increases the force with which a cartridge is coupled with a handle assembly to resist external force.

A further object of the present invention is to provide a shaver, which has increased cartridge supporting force, and has an improved structure for rotating a cartridge.

Technical Solution

In order to accomplish the above objects, the present invention provides a shaver including a removable cartridge and a handle assembly. The removable cartridge includes a cartridge body which is shaped such that part of upper and lower surfaces thereof is open, at least one blade which is mounted to the lower surface of the cartridge body, a connector mounting part which is provided on the upper surface of the cartridge body, and a connector which is mounted to the connector mounting part and has at a rear end thereof a holder mounting part. The handle assembly includes a handle body, a housing which is provided on a front end of the handle body, a holder which is mounted to a front end of the housing in such a way as to rotate around a pivot shaft and is removably mounted to the holder mounting part, a removing means which functions to removably couple the holder to the holder mounting part, a manipulating means which is installed in the housing in such a way as to be operated in conjunction with the removing means, and separates the holder from the holder mounting part, when physical force is applied to the removing means by external force, and is restored to an original position thereof by elastic force, and a support means which is installed in the housing in such a way as to be operated in conjunction with the holder and elastically supports rotating motion of the holder using elastic force.

The removing means includes a removing protrusion which is provided on a center of an upper portion of a rear end of the holder mounting part, elastic steps which extend downwards from opposite sides of the removing protrusion and are elastically rotated by the removing protrusion, and a removing hook which is provided on a front end of the holder to correspond to each of the elastic step.

The manipulating means includes an actuating button which is mounted to an upper surface of the housing and has an extension part which extends into the housing, a pusher which is installed in the housing and has a pusher protrusion which is provided on a front end of the pusher to be in close contact with the removing protrusion of the holder mounting part, and an insert hole which is formed in a rear end of the pusher so that the extension part is inserted into the insert hole, and an elastic member functioning to elastically support the pusher.

Further, the support means includes an inner housing which is installed in the housing and defines a plunger mounting space in which parts can be slid, a plunger which is mounted to a front end of the plunger mounting part and has a contact protrusion which is in close contact with a rear end of the holder, a plunger guide which is mounted to a rear end of the plunger mounting part, and an elastic member which is interposed between the plunger and the plunger guide and elastically supports the plunger.

The housing includes a lower housing having coupling holes which are coupled to coupling protrusions protruding from both sides of the front end of the handle body, and a pivot hole into which the pivot shaft of the holder is inserted, and an upper housing coupled to an upper portion of the lower housing.

Further, a hook seat is formed in a front end of the connector mounting part, while a hook is provided on a front end of the connector to be seated in the hook seat, and boss seats are provided on both sides of a rear end of the connector mounting part, while bosses are provided on both sides of a rear end of the connector and are inserted into the boss seats.

BRIEF DESCRIPTION OF THE DRAWINGS

FIG. 2 is a perspective view showing the state in which a cartridge and a handle included in the shaver of FIG. 1 are separated from each other;

FIG. 3 is an exploded perspective view showing the cartridge of FIG. 1;

FIG. 4 is a view showing the pivot structure of the cartridge of FIG. 1;

FIG. 5 is a plan view showing a shaver, according to the preferred embodiment of the present invention;

FIG. 18 is a plan view showing the cartridge of FIG. 5;

FIG. 19 is a sectional view taken along line E-E of FIG. 18;

FIG. 20 is a plan view showing the state in which a handle body is removed from FIG. 5;

MODE FOR THE INVENTION

Hereinafter, the preferred embodiment of the present invention, which accomplishes the above objects, will be described with reference to the accompanying drawings.

Figure 1:
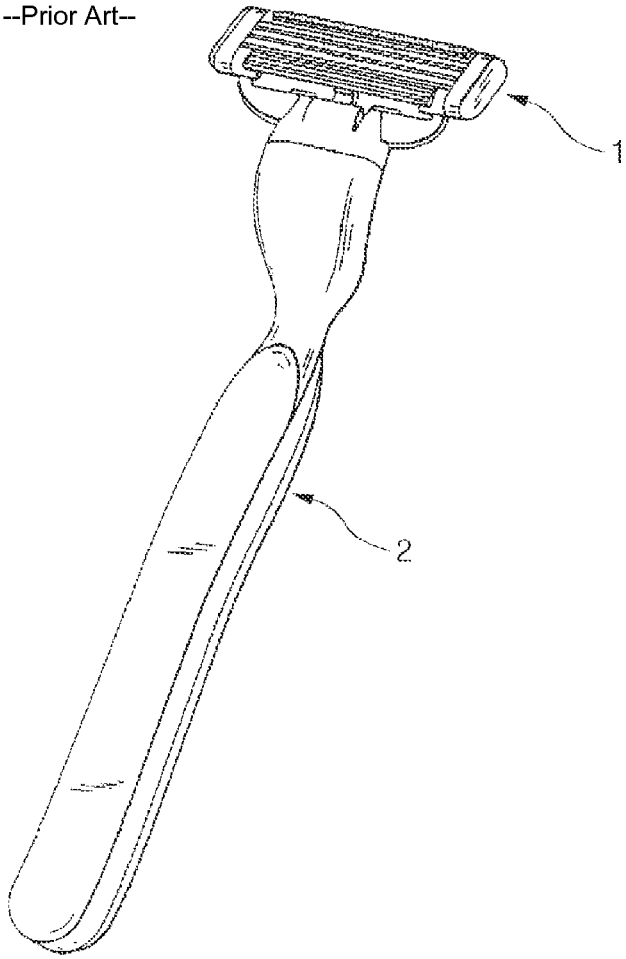
FIG. 1 is a perspective view showing a conventional shaver.
Figure 6:
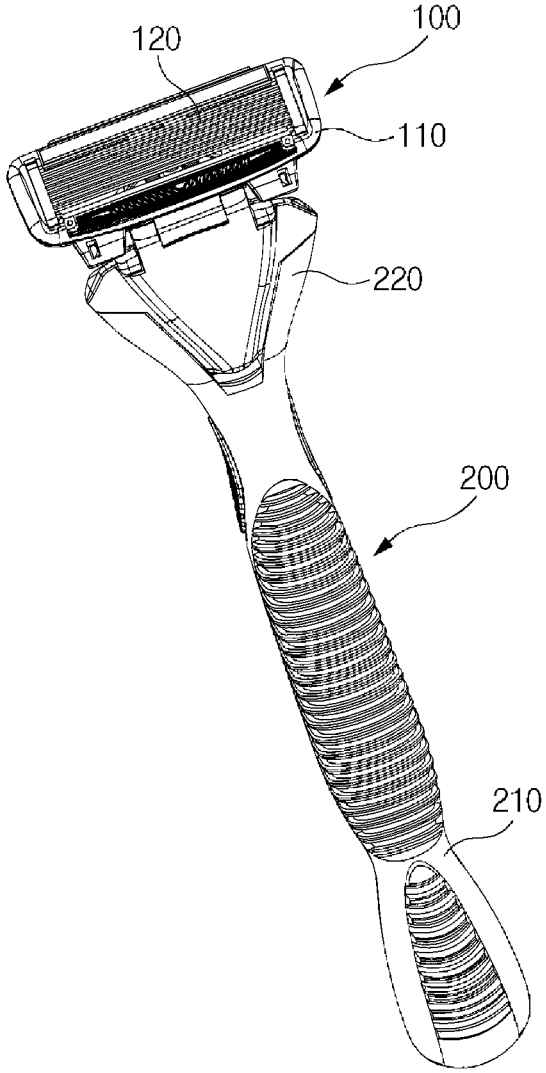
FIG. 6 is a bottom view showing the shaver, according to the preferred embodiment of the present invention.
Figure 7:
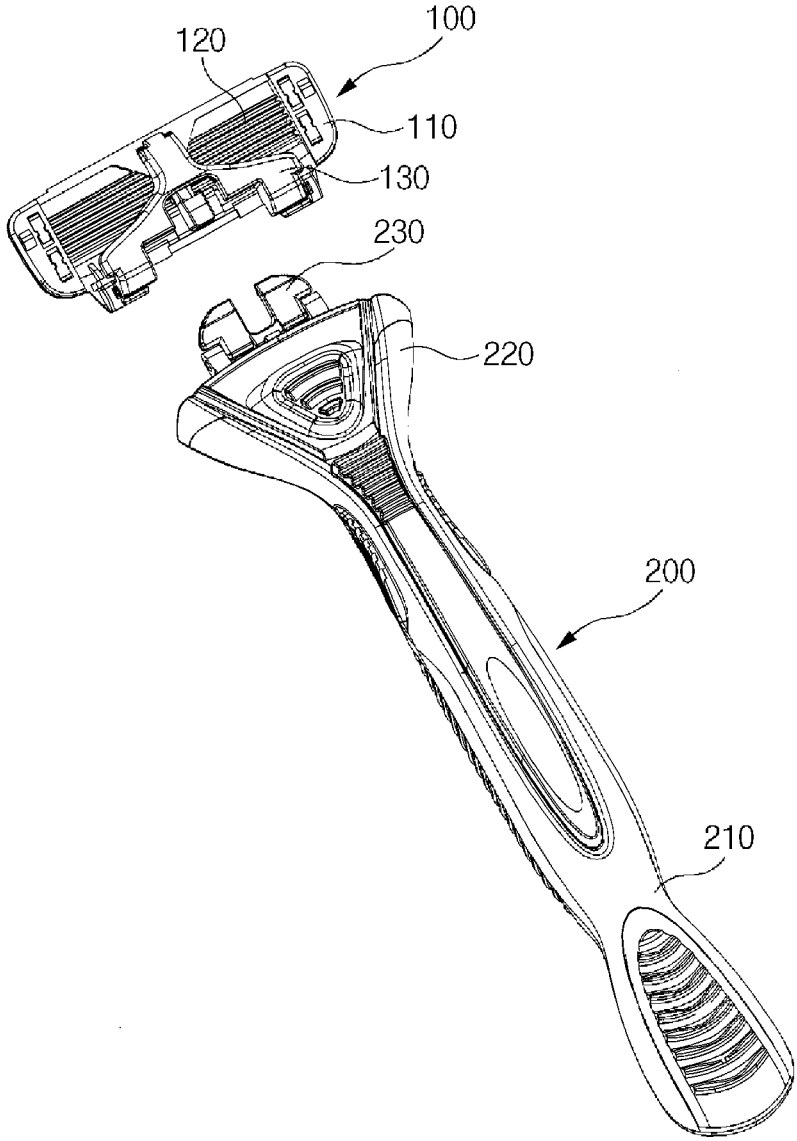
FIG. 7 is a perspective view showing the state in which a cartridge and a handle assembly included in the shaver of FIG. 5 are separated from each other.
Figure 8:
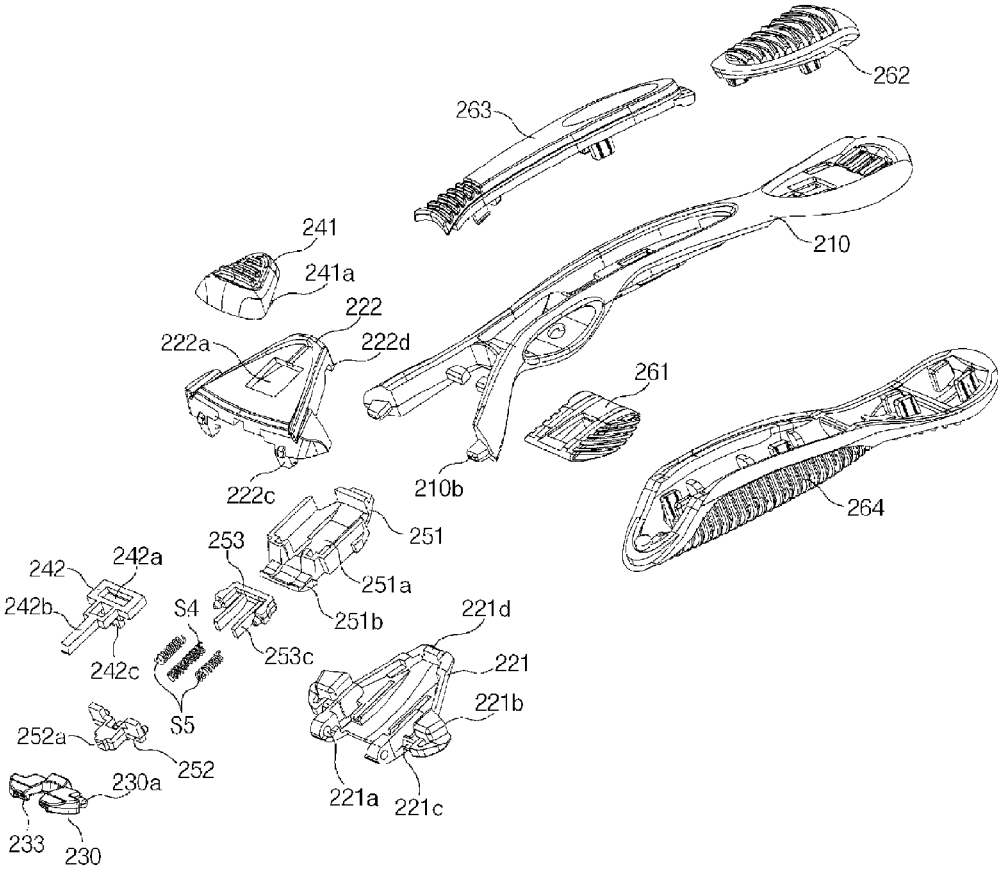
FIG. 8 is an exploded perspective view showing the handle assembly of FIG. 5.
Figure 9:
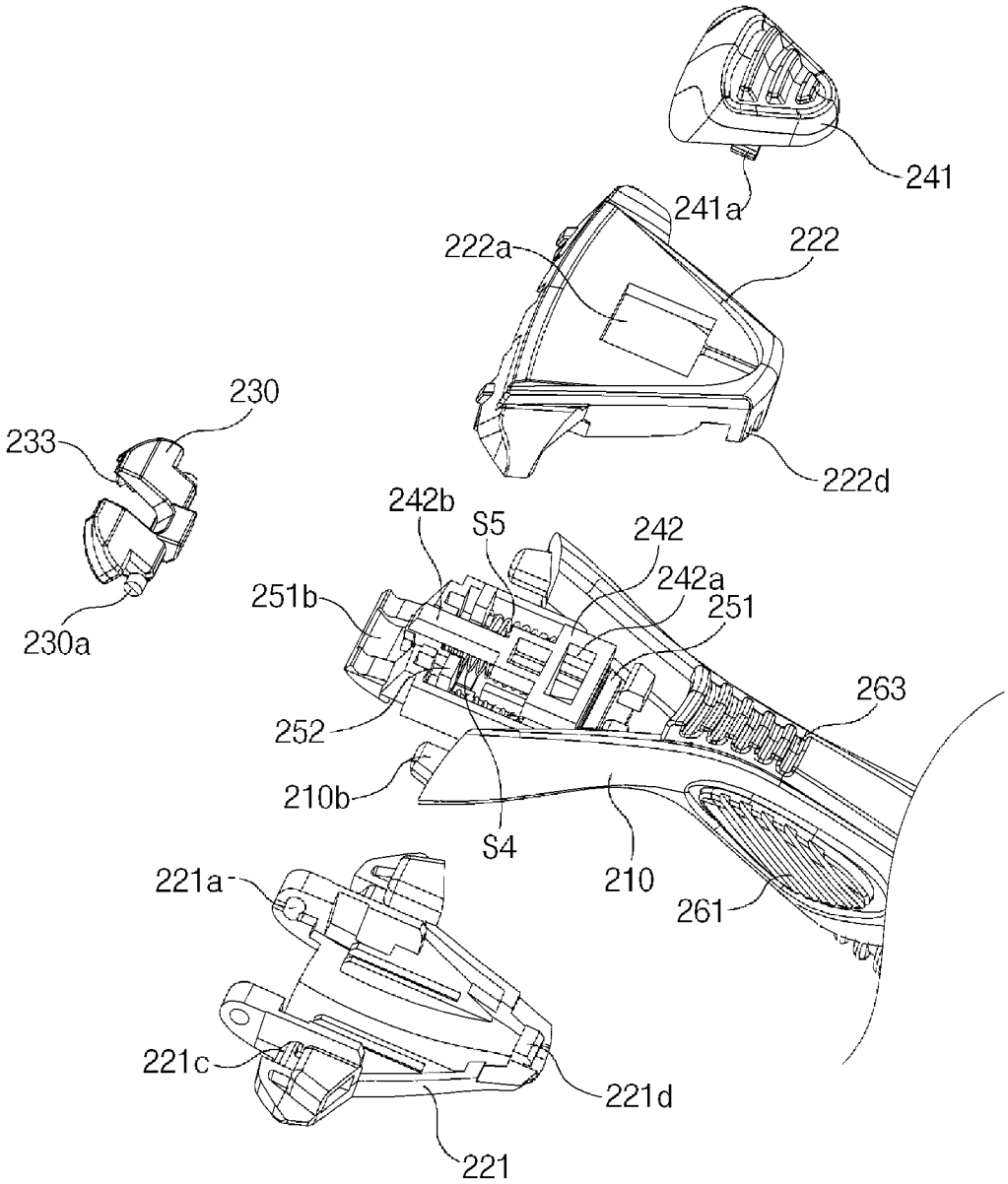
FIG. 9 is an exploded perspective view showing important parts of FIG. 8.

FIG. 5 is a plan view showing a shaver, according to the preferred embodiment of the present invention, FIG. 6 is a bottom view showing the shaver, according to the preferred embodiment of the present invention, FIG. 7 is a perspective view showing the state in which a cartridge and a handle assembly included in the shaver of FIG. 5 are separated from each other, FIG. 8 is an exploded perspective view showing the handle assembly of FIG. 5, and FIG. 9 is an exploded perspective view showing important parts of FIG. 8.

Figure 10:
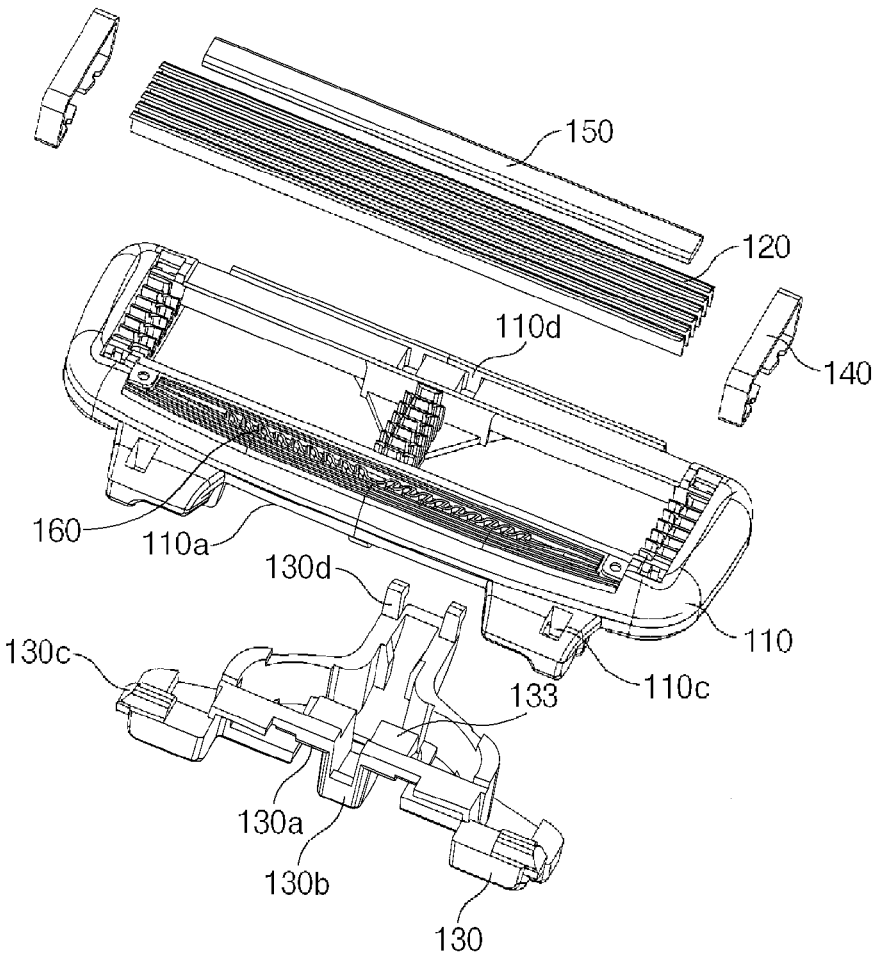
FIG. 10 is a bottom exploded perspective view showing the cartridge of FIG. 5.
Figure 11:
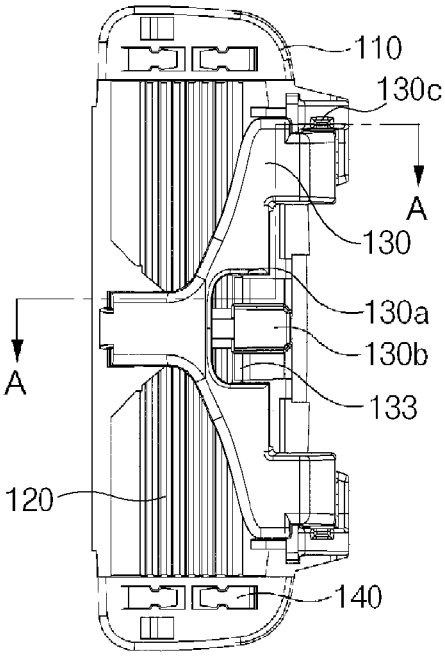
FIG. 11 is a bottom view showing the cartridge of FIG. 5.
Figure 12:
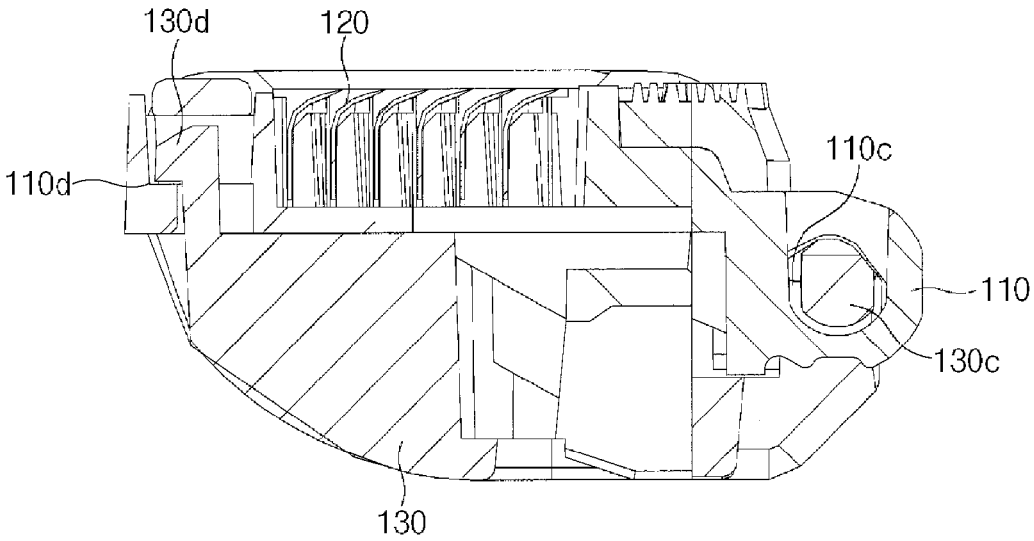
FIG. 12 is a sectional view taken along line A-A of FIG. 11.
Figure 13:
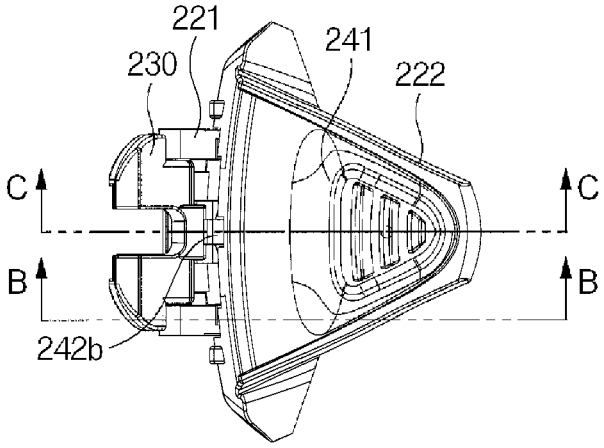
FIG. 13 is a plan view showing the state in which a holder of FIG. 8 is connected to a housing.
Figure 14:
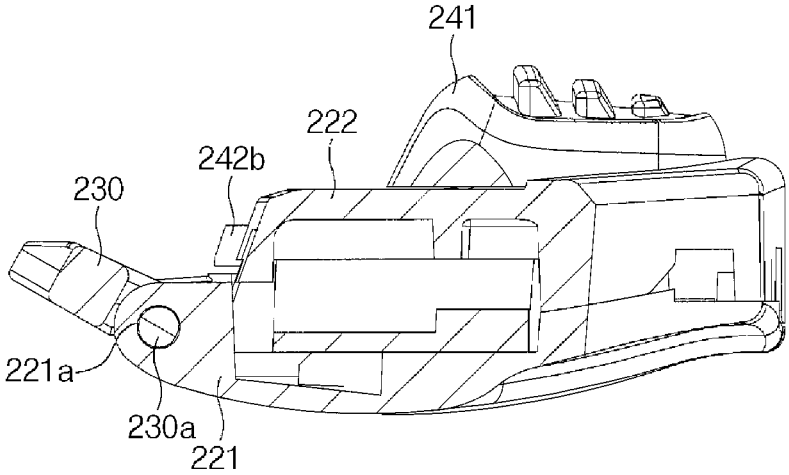
FIG. 14 is a sectional view taken along line B-B of FIG. 13.
Figure 15:
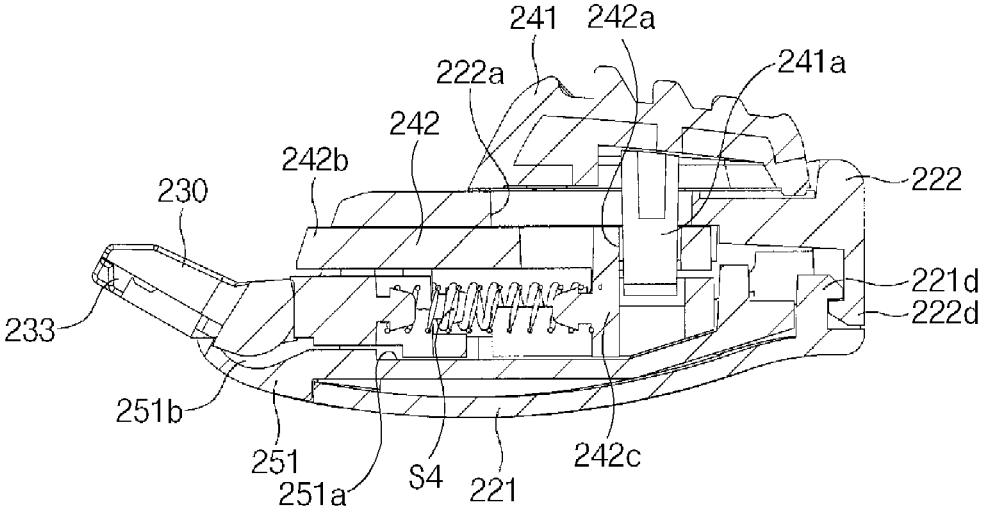
FIG. 15 is a sectional view taken along line C-C of FIG. 13.

Further, FIG. 10 is a bottom exploded perspective view showing the cartridge of FIG. 5, FIG. 11 is a bottom view showing the cartridge of FIG. 5, FIG. 12 is a sectional view taken along line A-A of FIG. 11, FIG. 13 is a plan view showing the state in which a holder of FIG. 8 is connected to a housing, FIG. 14 is a sectional view taken along line B-B of FIG. 13, and FIG. 15 is a sectional view taken along line C-C of FIG. 13.

Figure 16:
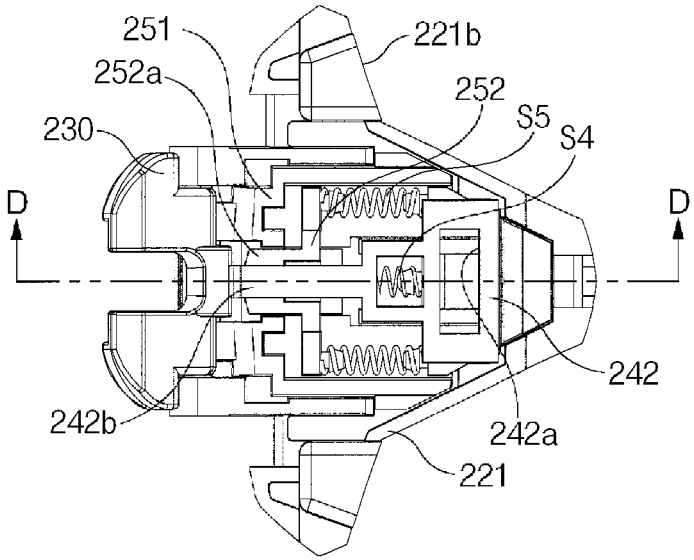
FIG. 16 is a plan view showing the state in which an upper housing is removed from FIG. 13.
Figure 17:
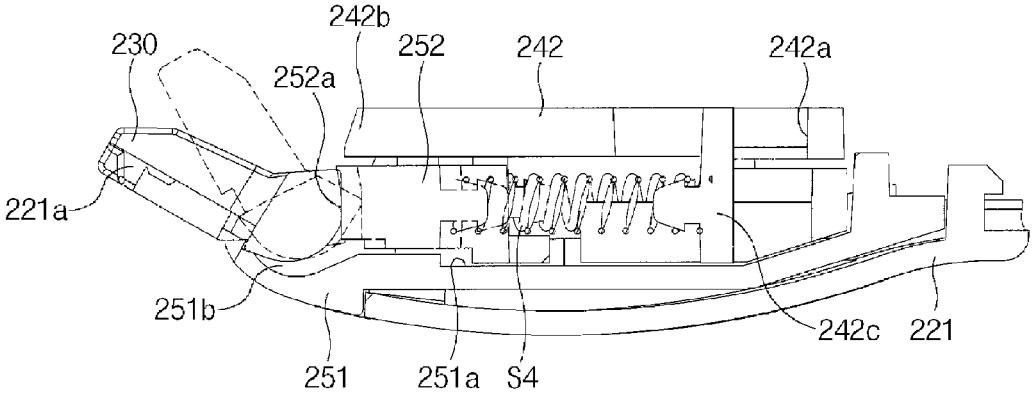
FIG. 17 is a sectional view taken along line D-D of FIG. 16.
Figure 21:
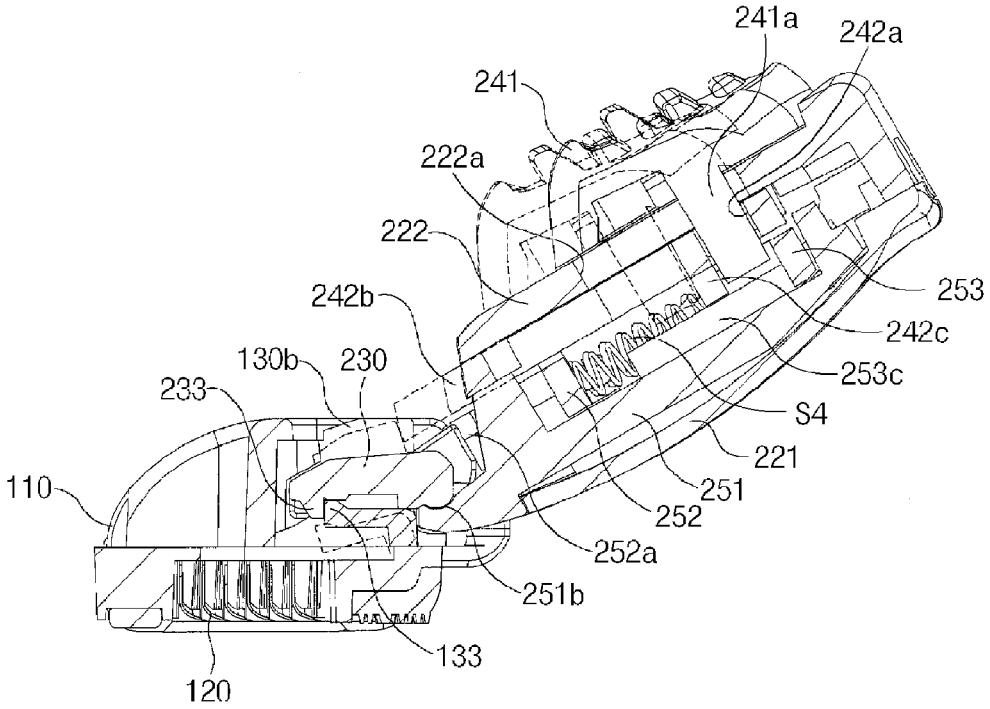
FIG. 21 is a sectional view taken along line F-F of FIG. 20.

Further, FIG. 16 is a plan view showing the state in which an upper housing is removed from FIG. 13, FIG. 17 is a sectional view taken along line D-D of FIG. 16, FIG. 18 is a plan view showing the cartridge of FIG. 5, FIG. 19 is a sectional view taken along line E-E of FIG. 18, FIG. 20 is a plan view showing the state in which a handle body is removed from FIG. 5, and FIG. 21 is a sectional view taken along line F-F of FIG. 20.

Figure 22:
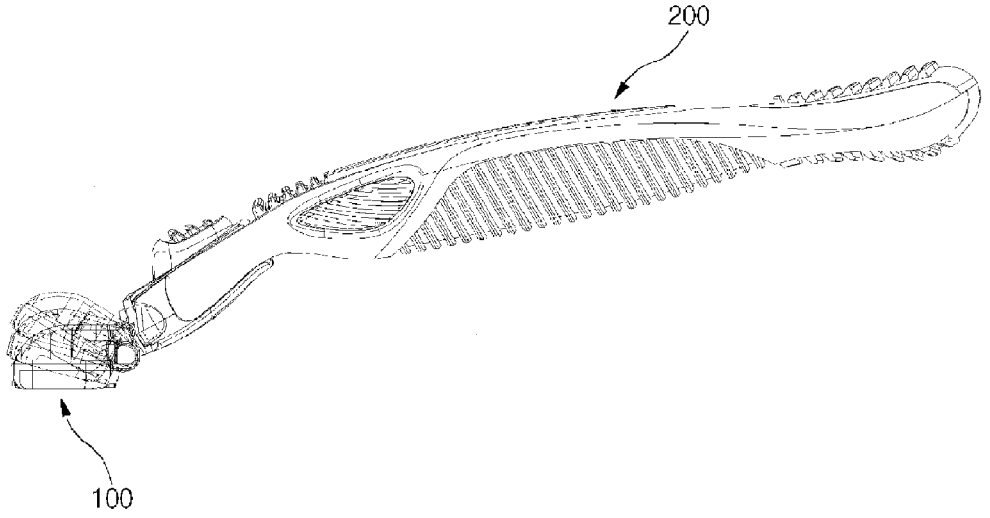
FIG. 22 is a side view showing the rotating structure of the cartridge, when a user shaves with the shaver according to the present invention.

Meanwhile, FIG. 22 is a side view showing the rotating structure of the cartridge when a user shaves with the shaver according to the present invention.

As shown in FIGS. 5 to 7, the shaver according to the present invention mainly includes a removable cartridge 100, and a handle assembly 200 which is removably coupled to the cartridge 100.

Here, referring to FIG. 10, the removable cartridge 100 includes a cartridge body 110, one or more blades 120, a connector mounting part 110*a*, and a connector 130. The cartridge body 110 is shaped such that part of its upper and lower surfaces is open. The blades 120 are fastened to the lower surface of the cartridge body 110. The connector mounting part 110*a* is provided on an upper surface of the cartridge body 110. The connector 130 is mounted to the connector mounting part 110*a*, and has at a rear end thereof a holder mounting part 130*a*.

Referring to FIGS. 8 and 9, the handle assembly 200 includes a handle body 210, a housing 220, a holder 230, a removing means, a manipulating means, and a support means. The housing 220 is provided on the front end of the handle body 210. The holder 230 is mounted to the front end of the housing 220 in such a way as to rotate around a pivot shaft 230*a*, and is removably mounted to the holder mounting part 130*a*. The removing means functions to removably couple the holder 230 to the holder mounting part 130*a*. The manipulating means is installed in the housing 220 in such a way as to be operated in conjunction with the removing means, separates the holder 230 from the holder mounting part 130*a* when physical force is applied to the removing means by external force, and is restored to its original position by elastic force. The support means is installed in the housing 220 in such a way as to be operated in conjunction with the holder 230, and elastically supports the rotation of the holder 230 using elastic force.

Here, the housing 220 includes a lower housing 221 and an upper housing 222. The lower housing 221 includes coupling holes 221*b*, into which coupling protrusions 210*b* protruding from both sides of the front end of the handle body 210 are inserted, and pivot holes 221*a*, into which the pivot shaft 230*a* of the holder 230 is inserted. The upper housing 222 is coupled to the upper portion of the lower housing 221.

Referring to FIGS. 18 and 19, the removing means includes a removing protrusion 130*b*, elastic steps 133, and removing hooks 233. The removing protrusion 130*b* is provided on the center of the upper portion of the rear end of the holder mounting part 130*a*. The elastic steps 133 extend downwards from the opposite sides of the removing protrusion 130*b*, and are elastically rotated by the removing protrusion 130*b*. The removing hooks 233 are provided on the front end of the holder 230 to correspond to the elastic steps 133.

Further, referring to FIGS. 20 and 21, the manipulating means includes an actuating button 241, a pusher 242, and an elastic member S4. The actuating button 241 is mounted to the upper surface of the upper housing 222, constituting the housing 220, and has an extension part 241*a* which extends into the upper housing 222. The pusher 242 is installed in a space defined between the upper and lower housings 222 and 221. A pusher protrusion 242*b* is provided on the front end of the pusher 242 and is in close contact with the removing protrusion 130*b* of the holder mounting part 130*a*, and an insert hole 242*a* is formed in the rear end of the pusher 242 so that the extension part 241*a* of the actuating button 241 is inserted into the insert hole 242*a*. The elastic member S4 functions to elastically support the pusher 242.

Referring to FIGS. 13 to 17, the support means includes an inner housing 251, a plunger 252, a plunger guide 253, and elastic members S5. The inner housing 251 is installed in the lower housing 221, and defines a plunger mounting space 251*a* in which parts can be slid. The plunger 252 is mounted to the front end of the plunger mounting part 251*a*, and includes a contact protrusion 252*a* which is in close contact with the rear end of the holder 230. The plunger guide 253 is mounted to the rear end of the plunger mounting part 251*a*. The elastic members S5 are interposed between the plunger 252 and the plunger guide 253, and elastically support the plunger 252.

Meanwhile, referring to FIG. 8, the pusher 242 is provided with a support part 242*c* which extends to the plunger guide 253. Preferably, guide bars 253*c* are provided on the plunger guide 253, extend a predetermined distance in the moving direction of the pusher 242, and are in close contact with the support part 242*c* to support the movement of the support part 242*c*.

More preferably, a shaft support 251*b* protrudes from the front end of the inner housing 251 to support the pivot shaft 230*a* of the holder 230.

Further, referring to FIGS. 11 and 12, hook seats 110*d* are formed in the front end of the connector mounting part 110*a*, and hooks 130*d* are provided on the front end of the connector 130 to be seated in the corresponding hook seats 110*d*. Boss seats 110*c* are provided in both sides of the rear end of the connector mounting part 110*a*, while bosses 130*c* are provided on both sides of the rear end of the connector 130 to be inserted into the boss seats 110*c*.

Meanwhile, referring to FIG. 10, the cartridge 100 further includes clips 140, a lubricating band 150, and a guide part 160. The clips 140 are installed at the cartridge body 110 to hold opposite ends of the blades 120. The lubricating band 150 is mounted to one side of the blades 120. The guide part 160 is mounted to the other side of the blades 120, and allows the blades to come into closer contact with a user's skin during shaving. Preferably, the guide part 160 has a wave shape in the direction of the blades 120.

Further, referring to FIG. 8, inserts are preferably installed in the handle body 210 of the handle assembly 200 so as to provide proper weight to the handle assembly 200 and prevent the deformation of the handle body 210, in addition to improving grip sensitivity.

In this case, the inserts include a front insert 261 which is installed on the front end of the handle body 210, a rear insert 262 which is installed on the rear end of the handle body 210, an upper insert 263, which is mounted to the upper portion of the handle body 210, and a lower insert 264, which is mounted to the lower portion of the handle body 210.

Meanwhile, as shown in FIG. 10, the cartridge body 110 according to the present invention is formed such that the lower surface of the cartridge body 110, to which the blades 120 are mounted, and the upper surface of the cartridge body 110, to which the connector 130 is mounted, are open. This construction allows a beard, cut by the blades 120 while shaving, to be smoothly discharged through the open upper surface of the cartridge body 110.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

Therefore, it is to be understood that the invention is illustrative and not restrictive, and all changes that fall within the meets and bounds of the claims, or equivalents of such meets and bounds, are intended to be covered by the claims.

INDUSTRIAL APPLICABILITY

As described above, the present invention provides a shaver, in which a cartridge and a handle assembly are removably coupled to each other using a connector, which is firmly coupled to the cartridge, and a holder, which is coupled to the handle assembly in such a way as to rotate around a pivot shaft, thus achieving a simple removable structure, increasing coupling force, and increasing the force with which the cartridge is supported.

Further, the present invention provides a shaver, in which a pivot support shaft structure for rotating a cartridge is realized by a holder which is coupled to a handle assembly via a pivot shaft, and the cartridge is simply coupled to the holder via a connector, thus preventing the cartridge and the handle assembly from being undesirably separated from each other or breaking even when external force is applied to the cartridge, and the cartridge elastically rotates around the pivot shaft, thus affording smooth rotating motion.

Further, the present invention provides a shaver, in which a cartridge and a handle assembly are coupled to each other using hooks and bosses of a connector mounted to the cartridge and a holder mounted to the handle assembly, thus achieving a simpler structure and increasing coupling force compared to a conventional coupling structure using a spring.

Furthermore, the present invention provides a shaver, in which the upper surface of a cartridge body, to which a connector is mounted, is open, thus allowing a beard, cut by blades while shaving, to be smoothly discharged.

The invention claimed is:

1. A shaver, comprising:

a removable cartridge, comprising:

a cartridge body shaped such that part of upper and lower surfaces thereof is open;

at least one blade mounted to the lower surface of the cartridge body;

a connector mounting part provided on the upper surface of the cartridge body; and a connector mounted to the connector mounting part, and having at a rear end thereof a holder mounting part; and a handle assembly, comprising:

a handle body;

a housing provided on a front end of the handle body;

a holder mounted to a front end of the housing in such a way as to rotate around a pivot shaft;

means for removably coupling the holder to the holder mounting part;

means for separating the holder from the holder mounting part when physical force is applied to the means for removably coupling by external force, the holder being restored to an original position thereof by elastic force, the means for separating being installed in the housing and being operated in conjunction with the means for removably coupling; and means for elastically supporting rotating motion of the holder using elastic force, the means for elastically supporting being installed in the housing and being operated in conjunction with the holder, wherein the means for removably coupling comprises:

a removing protrusion provided on a center of an upper portion of a rear end of the holder mounting part;

elastic steps extending downwards from opposite sides of the removing protrusion, and configured to be elastically rotated by the removing protrusion; and a removing hook provided on a front end of the holder to correspond to each of the elastic steps, the means for separating comprises:

an actuating button mounted to an upper surface of the housing, and having an extension part which extends into the housing;

a pusher installed in the housing, and comprising a pusher protrusion which is provided on a front end of the pusher to be in close contact with the removing protrusion of the holder mounting part, and an insert hole which is formed in a rear end of the pusher so that the extension part is inserted into the insert hole; and an elastic member providing the elastic force functioning to elastically support the pusher, and the means for elastically supporting comprises:

an inner housing installed in the housing, and defining a plunger mounting space in which a plunger can be slid;

the plunger mounted to a front end of the plunger mounting part, and having a contact protrusion which is in close contact with a rear end of the holder;

a plunger guide mounted to a rear end of the plunger mounting part; and an elastic member interposed between the plunger and the plunger guide, and providing the elastic force elastically supporting the plunger.

2. A shaver, comprising:

a removable cartridge, comprising:

a cartridge body shaped such that part of upper and lower surfaces thereof is open;

at least one blade mounted to the lower surface of the cartridge body;

a connector mounting part provided on the upper surface of the cartridge body; and a connector mounted to the connector mounting part, and having at a rear end thereof a holder mounting part; and a handle assembly, comprising:

a handle body;

a housing provided on a front end of the handle body;

a holder mounted to a front end of the housing in such a way as to rotate around a pivot shaft;

means for removably coupling the holder to the holder mounting part;

means for separating the holder from the holder mounting part when physical force is applied to the means for removably coupling by external force, the holder being restored to an original position thereof by elastic force, the means for separating being installed in the housing and being operated in conjunction with the means for removably coupling; and means for elastically supporting rotating motion of the holder using elastic force, the means for elastically supporting being installed in the housing and being operated in conjunction with the holder, wherein the housing comprises:

a lower housing having coupling holes which are coupled to coupling protrusions protruding from both sides of the front end of the handle body, and a pivot hole into which the pivot shaft of the holder is inserted; and an upper housing coupled to an upper portion of the lower housing.

3. A shaver, comprising:

a removable cartridge, comprising:

a cartridge body shaped such that part of upper and lower surfaces thereof is open;

at least one blade mounted to the lower surface of the cartridge body;

a connector mounting part provided on the upper surface of the cartridge body; and a connector mounted to the connector mounting part, and having at a rear end thereof a holder mounting part; and a handle assembly, comprising:

a handle body;

a housing provided on a front end of the handle body;

a holder mounted to a front end of the housing in such a way as to rotate around a pivot shaft;

means for removably coupling the holder to the holder mounting part;

means for separating the holder from the holder mounting part when physical force is applied to the means for removably coupling by external force, the holder being restored to an original position thereof by elastic force, the means for separating being installed in the housing and being operated in conjunction with the means for removably coupling; and means for elastically supporting rotating motion of the holder using elastic force, the means for elastically supporting being installed in the housing and being operated in conjunction with the holder, wherein a hook seat is formed in a front end of the connector mounting part, while a hook is provided on a front end of the connector to be seated in the hook seat, and boss seats are provided on both sides of a rear end of the connector mounting part, while bosses are provided on both sides of a rear end of the connector and are inserted into the boss seats.

* * * * *